US008137025B2

(12) United States Patent
Wiley

(10) Patent No.: US 8,137,025 B2
(45) Date of Patent: Mar. 20, 2012

(54) PROCESS FOR THE REJUVENATION OF ASPHALT ROAD SURFACES

(76) Inventor: Pat Wiley, Chilliwack (CA)

( * ) Notice: Subject to any disclaimer, the term of this patent is extended or adjusted under 35 U.S.C. 154(b) by 0 days.

(21) Appl. No.: 12/373,807

(22) PCT Filed: Jul. 12, 2007

(86) PCT No.: PCT/CA2007/001226

§ 371 (c)(1),
(2), (4) Date: Jan. 14, 2009

(87) PCT Pub. No.: WO2008/006208

PCT Pub. Date: Jan. 17, 2008

(65) Prior Publication Data

US 2010/0209188 A1 Aug. 19, 2010

(51) Int. Cl.
*E01C 7/06* (2006.01)
*E01C 23/14* (2006.01)
*E01C 23/08* (2006.01)

(52) U.S. Cl. ..... 404/77; 404/79; 404/91

(58) Field of Classification Search ..... 404/71, 404/75, 77, 79, 90–96

See application file for complete search history.

(56) References Cited

U.S. PATENT DOCUMENTS

| | | | | |
|---|---|---|---|---|
| 4,545,700 | A * | 10/1985 | Yates | 404/75 |
| 4,784,518 | A | 11/1988 | Cutler | |
| 4,793,730 | A | 12/1988 | Butch | |
| 4,850,740 | A | 7/1989 | Wiley | |
| 4,929,120 | A | 5/1990 | Wiley et al. | |
| 6,220,782 | B1 | 4/2001 | Yates | |
| 6,439,804 | B1 * | 8/2002 | Crupi | 404/75 |
| 6,695,530 | B2 | 2/2004 | Crupi | |

FOREIGN PATENT DOCUMENTS

| | | |
|---|---|---|
| CA | 204200 | 11/1992 |
| EP | 628110 | 9/1999 |

* cited by examiner

*Primary Examiner* — Thomas Will
*Assistant Examiner* — Abigail A Risic

(57) ABSTRACT

An asphalt-paved road surface is rejuvenated in a multi-stage recycling process. The first process stage involves grinding, to a selected depth and width, a first strip portion of the surface and transporting it away from the site. The second process stage involves heating and grinding, to a selected temperature and depth, the upper layer of a second strip portion and moving it to the first strip portion to expose a lower layer. The third process stage involves heating and grinding, to a selected temperature and depth, the exposed lower layer of the second strip portion and moving it to the first strip portion. New asphalt is then added to rejuvenate the recycled asphalt and to maintain the grade elevation. The mixture is then placed back on the road surface using conventional means.

11 Claims, 1 Drawing Sheet

PROCESS FOR THE REJUVENATION OF ASPHALT ROAD SURFACES

BACKGROUND OF THE INVENTION

Since the early 1970s the increased cost of petroleum products has driven a growing interest in the recycling of asphalt paved road surfaces. It has become increasingly important to recycle in order to preserve these non-renewable resources and save cost.

An asphalt paved road surface is made up of a combination of graded aggregates (crushed rock and sand) and asphalt cement (a dark, sticky petroleum based adhesive) and air voids. These materials are typically blended together in a central plant, delivered to the roadway by trucks and spread and compressed onto the road surface.

It is well known that over time asphalt-paved road surfaces age and deteriorate for a number of reasons. Temperature fluctuations, precipitation, and UV exposure cause the pavement to lose its flexibility, which causes the surface to crack and deteriorate. Moreover, chemicals within the asphalt cement gradually dissipate or their properties change (harden and lose adhesive properties) further causing the eventual failure of the surface.

Originally, pavement recycling involved cold milling machines that were used to grind out an aged or damaged pavement which was then hauled back to a central processing plant where it would be heated and mixed with new material. The mixture would then be hauled back to the road site and be reinstalled back on the road surface. Generally speaking the cold grinding of aged or damaged pavement tends to fracture the aggregate requiring the selected addition of new aggregate material to compensate for the fractured aggregate.

Subsequently insitu processes for the recycling of asphalt have been developed. Some such processes involve heating and are frequently referred to as "hot in-place asphalt recycling" (hereinafter referred to as HIPAR).

HIPAR consists of many known methods and machines but generally it involves insitu heating the asphalt pavement to soften, loosening the softened pavement with scarifiers or grinders, adding and mixing in new asphalt mix and rejuvenating oils and then reinstalling the combined mixture back on the road surface at substantially the same grade elevation. It is important not to add too much new asphalt mix using this technique or the newly repaved lane will be too high in relation to the adjoining lane resulting in a safety hazard to motorists.

The prior art has evolved a number of techniques for carrying out HIPAR on asphalt road surfaces. Typically the prior art incorporates large infrared or hot air heaters, which heat the road surface to about 275to 350 F. When the pavement is heated to this temperature range it becomes softened enough to remove it without crushing the aggregates. Overheating the surface to greater temperatures can result in hardening and loss of adhesive properties of the asphalt cement. Moreover overheating result in excessive blue and black smoke emissions which not only damage the environment but also cause a safety hazard to the workers and motorists in the area.

When recycling a paved surface it is advantageous to achieve a depth of processing of least 1.5 to 2 inches in order to sufficient remove cracks and defects and prevent or delay their return. Due to the poor thermal conductivity of aged asphalt pavement achieving this depth without overheating has generally not been possible.

One technique that was developed comprised heating and processing the pavement in two or more stages (hereinafter referred to as Multi-Stage), which in one example consisted of heating and removing layers of 0.5 to 1 inch thickness per stage. The Multi-Stage technique overcame some of the previously mentioned challenges but faced new problems resulting from managing the asphalt removed from the first removed layer while heating and grinding the second layer. In the case of three and four stage machines this problem progressed beyond the first and second layers.

One prior art Multi-Stage technique of dealing with this problem is described U.S. Pat. No. 4,929,120 issued to Wiley and Rorison. A conveyor is used to carry the asphalt removed from the first layer over top of the subsequent heater. Although this patent represents an advance over the prior art, considerable capital cost and maintenance cost can be incurred for such a conveyor.

A second prior art method of dealing with this problem is described in U.S. Pat. No. 4,850,740 issued to Wiley. This patent describes a prior art method and apparatus whereby there is a longitudinal gap in the center of the second and subsequent heaters banks to allow the heated, windrowed asphalt removed from the first and subsequent layers to pass through without overheating. Again while this patent represents an additional advance over the prior art, issues can arise in that the existing paved surface beneath the gap in the subsequent heaters does not get heated sufficiently. This is partly due to the poor heat transfer from the hot windrow to the unground pavement surface below. The windrow is simply not hot enough to sufficiently heat the unground pavement surface below. In addition air voids present in the loosened asphalt in the windrow inhibit heat transfer to a sustained temperature right against the unground pavement below the windrow. The resulting lack of heating and softening in the area below the previous removed windrow causes the aggregates in this lower area to become fractured during milling which reduces the quality of final recycled asphalt product. Another problem encountered is that this asphalt cement within this unheated material does not become hot enough to become liquid or pliable and, therefore, it does not bind with the other material in the roadway or become mixed with the later added rejuvenators. Another issue to be considered is the cooling effect this unheated material has on the total final mixture. This means the other materials not in this area below the heated windrow must be heated to a higher temperature to compensate to achieve the desired temperatures for proper mixing in of rejuvenates and pressing (compacting) back on the road. This can result in overheating of the road surface damaging the asphalt cement and causing smoke emissions as mentioned previously.

It is an object of this invention to provide an improved method of rejuvenating an asphalt paved road surface and its associated apparatus.

It is an aspect of this invention to provide a method of rejuvenating an asphalt paved road surface comprising: grinding a portion of the road surface to produce a first ground or loosened asphalt portion; removing the first loosened asphalt portion to present a recess in the remaining portion of the road; heating the remaining portion of said road; grinding the heated remaining portion of the road to present a second loosened asphalt portion; gathering the second loosened asphalt portion on to the recess means and exposing a lower layer of remaining portion of the road; heating the lower layer of the remaining portion of the road; gathering the heated lower layer of the remaining portion of the road to present a third loosened asphalt portion; commingling the third loosened asphalt portion with the second loosened asphalt portion onto the recess means; introducing fresh asphalt to the commingled asphalt portion so as to repair the road.

It is another aspect of this invention to provide a method of rejuvenating an asphalt paved road surface comprising: grinding a first portion of the road surface to a selected depth and width to produce a first loosened asphalt portion; removing the first loosened asphalt portion to present a strip in the central region of the remaining portion of the road surface; heating the remaining portion of the road surface to a selected temperature and time duration; grinding the heated remaining portion of the road surface to a selected depth to present a second loosened asphalt portion; windrowing the second loosened asphalt portion onto the strip to expose a lower layer of the remaining portion of the road; heating the lower layer of the remaining portion of the road to a selected temperature and time duration; grinding the heated lower layer of the remaining portion of the road to a selected depth to present a third loosened asphalt portion; windrowing the third loosened asphalt portion on to the strip and commingling the third loosened asphalt portion with the second loosened asphalt portion; introducing fresh asphalt to the commingled asphalt portions so as to repair the road.

These and other objects and features of the invention shall now be described in relation to the drawings.

DETAILED DESCRIPTION OF THE INVENTION

Figure 1:
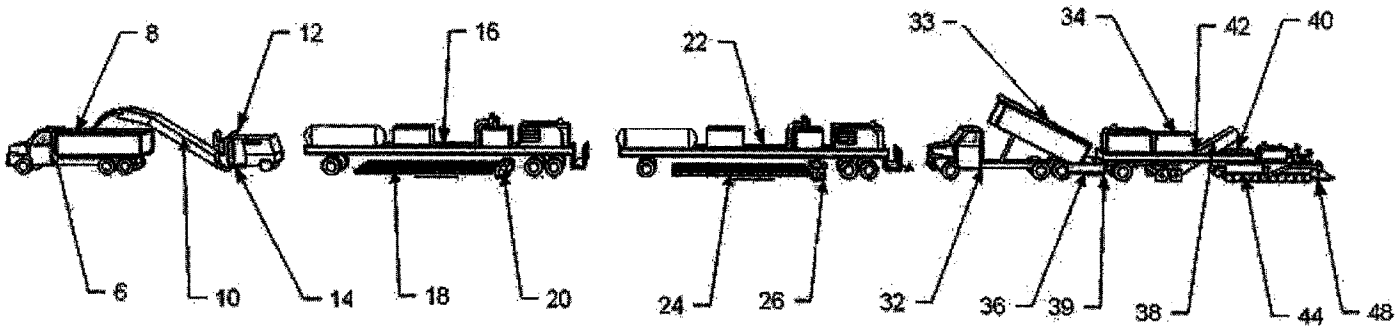
FIG. 1 is a schematic illustration depicting a series of machines employed to rejuvenate an asphalt-paved road surface in accordance with the preferred embodiment of the invention.
Figure 2:
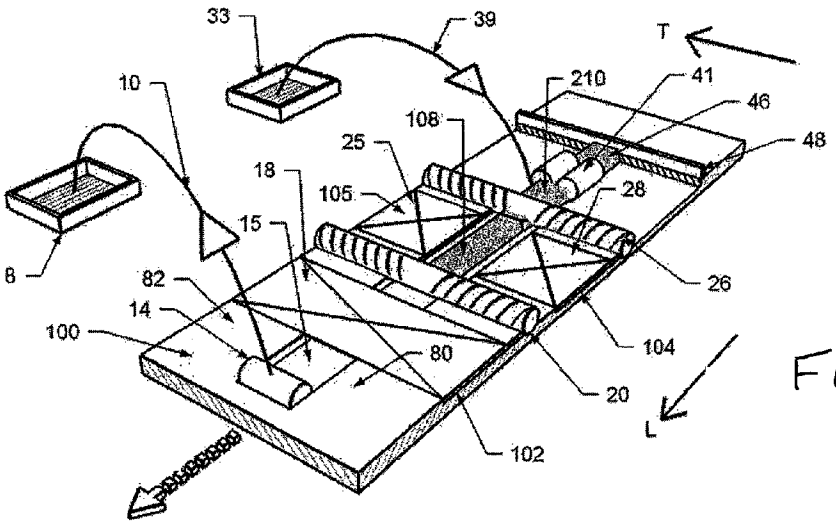
FIG. 2 is a pictorial illustration depicting the sequence of steps employed in practicing the invention according to its preferred embodiment.

Vehicle 6 is a vehicle with a truck box 8 for hauling away removed asphalt. Self propelled machine 12 is equipped with a powered milling drum 14 that grinds a first recess means, or strip portion 15 of the road surface to a desired depth and width. The recess means or recess generally consists of a strip that is formed in the longitudinal direction L of the road and is generally located in the central region of the road. However, the strip 15 could be to the side of the road and consist of two narrower strips on either side.

Machine 12 then removes the ground up or loosened asphalt from first strip portion 15 with a conveyor 10 and loads it into truck box 8 to be hauled away as a first ground, loosened or ruptured asphalt portion. In the embodiment illustrated, the grinding can comprise cold grinding, although the surface could also be preheated.

The first strip portion 15 provides a recess means or region to receive or store the subsequent portions of asphalt in a manner described below. Once the longitudinal section of strip 15 is formed, there is a remaining transverse portion 80 and 82. In other words, as the machine moves along a longitudinal direction L, a first loosened portion of asphalt is produced, and once removed a strip 15 is defined in the remaining outer strips 80 and 82.

A second self-propelled machine 16 is equipped with a bank of under slung heaters 18 which may be lowered to within a few inches of the upper layer of the road surface 100. Machine 16 is driven along a section of road surface 100 which in one example can be recycled at a speed of about 12 to 25 feet per minute to heat the upper layer 102 of the road surface to temperature of about 180 to 300 F to a depth of about 0.5 inch to 1 inch. A transversely mounted grinder 20 is mounted at the rear end of heater 18. Grinder 20 removes the outer strips 80 and 82 of heated upper asphalt layer 102 from road surface 100 to form a second loosened asphalt portion and augers the second loosened asphalt portion to form a first windrow 108 contained within the first strip portion 15. The outer strips 80 and 82 are disposed generally transversally of the road surface as shown.

Although the invention has been described in the context of grinding, the benefits of the invention may also be realized by loosening the asphalt by any mechanical means, which includes scarifying.

The heater 18 could heat the entire transverse width of the surface 100 (in which case this first strip portion 15 could also be heated or preheated); or the heater 18 could heat the upper layer of the road surface 100 except in the area of the first strip portion. Alternatively, the heater could be all the way across and the heater turned down over the windrow.

A third, self-propelled machine 22 follows behind machine 16. is equipped with two side by side under slung heaters 24 and 28 which heat and soften the exposed second layer outer strips 104 and 105. Under slung heaters 24 and 28 have a longitudinal space the width of the first strip portion 15 between them in order to prevent overheating of the asphalt windrow 108. A transversely mounted grinder 26 is mounted at the rear end of heaters 24 and 28. Grinder 26 removes the exposed second layer outer strips 104 and 105 from road surface 100 or a third loosened asphalt portion and augers the third loosened asphalt portion to be commingled with second loosened asphalt portion windrowed 108 to form a larger or commingled windrow 210 in the center of the road surface 100. The lower layer of the remaining portions of the road comprises a transverse section of the road. Hauling truck 32 has a truck box 33 for delivering fresh asphalt. Machine 42 has a front mounted receiving hopper 36 capable of receiving new asphalt mix from hauling truck box 33. Machine 42 includes a feed conveyor 39 capable of adding the fresh asphalt to the windrowed asphalt 210. Machine 42 also has storage and metering system 34 capable of adding rejuvenators to the windrowed asphalt 210. The machine 42 also includes a conveyor 38 which elevates the larger windrow 210 which consists of the combination of the first windrow 108 and ground heated strips 104 and deposits them into mixing chamber 40 where they are mixed together by rotating mixers 41 to form a final rejuvenated asphalt mixture 46. The final rejuvenated asphalt mixture 46 is then deposited into the receiving hopper 44 of conventional paving machine. The final rejuvenated asphalt mixture 46 is then spread back onto the road surface by screed device 48 and this is compacted using conventional methods.

Alternatively, the windrowed loosened asphalt 210 that consists of commingled second and third loosened asphalt portions can be consolidated by paving. The thickness in this case would not reach the original thickness of the asphalt road since the first loosened asphalt portion was removed. A thin layer of fresh or repaved asphalt may be added later. In other words, the fresh asphalt may be commingled with the second and third loosened asphalt portion or the fresh asphalt can be added later as a surface layer.

Advantages of the invention described herein include:

1. Once the initial ground asphalt from the first strip portion 15 is hauled away, there is no need to pick up any further ground material and convey it along or over subsequent heating elements or grinders. The absence of any conveyors required for such purposes considerably reduces the capital cost and increases the reliability of the equipment.

2. The full width and depth of the entire asphalt layer being rejuvenated will be heated sufficiently to become softened for grinding with substantially reduced damage to the aggregates.
3. The asphalt cement contained within the full width and depth of the entire asphalt layer being rejuvenated will be heated sufficiently for it to be lignified so that it can be mixed properly with rejuvenators within the process and properly adhere to other asphalt within the total mixture.
4. By removing a first strip portion of existing asphalt new rejuvenating asphalt can be added without changing the grade elevation of the recycled lane. This reduces safety hazards for motorists relating to uneven lane elevations.
5. Typically 10-25% new asphalt is added for existing technologies in order to avoid uneven lane elevations. By selecting the volume of ground or loosened asphalt removed from the first strip portions higher ratios of new asphalt could be added which is desirable for higher quality resurfacing characteristics such as strength and density of the rejuvenated surface; while at the same time reducing capital costs of conveyor equipment, and reducing operation costs in hauling away the ground heated material to be mixed with the new asphalt offsite.
6. The speed of the process described herein is increased over the prior art. For example, in one embodiment when a 2 foot strip was removed in first portion 15, time savings were experienced in resurfacing the surface 100.

As described above, the final rejuvenated asphalt mixture comprises a ratio of:

1. new mix
2. existing mix.
3. rejuventating oils This ratio can be measured by the volume of new mix added to the existing mix.

Generally speaking the volume of the new mix added will be the same or slightly greater than the volume of the first ground asphalt portion which is removed when producing the recess as previously described. The accuracy of the final ratio is depended on the accuracy of controlling the volume of the first ground asphalt portion which is milled and then removed.

Therefore, if one finds a way of improving the accuracy of the volume of the first ground asphalt portion to be removed, the accuracy of the method of rejuvenating an asphalt paved road surface will be enhanced such that the addition of the new mix will more accurately reflect the volume of the first ground asphalt portion that is removed so as to ensure that the height of the rejuvenated surface more closely reflects the height of the pre-rejuvenated asphalt surface of the road.

It has been found that the accuracy of the ratio can be more tightly controlled for a given volume of first ground asphalt portion which is removed by increasing the milling depth and decreasing the milling width of the strip 15. In other words, one can remove the same volume asphalt surface by decreasing the width of the strip 15 while at the same time increasing the depth of the milling cut.

EXAMPLE

If one attempted to mill the entire width of a typical 12 foot wide road (144 inches) to a depth of 2 inches, where 25 percent of the 2 inch depth was milled to produce the first ground asphalt portion previously described, it would be normal to obtain a variance of up to (Var) of ±¼ inch in the depth of cut due to existing technologies of the machines used and the normal longitudinal and transverse surface variations including frost heaves, bumps, wheel path ruts, studded tire wear and raveling. The milling of the width of the road surface is generally more easily controlled by utilizing a single grinding drum of a desired width. There would still be a variance in the width of cut, but this variance would be typically small and insignificant in comparison to the variance in the depth of cut.

Accordingly, per unit length L of cut in the road surface (i.e., in the longitudinal direction), the volume of the first ground asphalt portion which is removed can be represented by the following formula:

$$\text{Volume}=W\,(\text{width of cut in strip 25})\times D\,(\text{depth of cut})\times L\,(\text{unit length in longitudinal direction})$$

Therefore, if one cuts the entire width of the 12 foot lane to a depth of ½ inch having a variance in the depth of cut of ±¼ inch, the volume V and Var is:

$$V=144\times\tfrac{1}{2}\text{ inch}\times 1=72\text{ in}^3\text{ with a Var of }\pm 36\text{ in}^3\text{ since the variance is equal to }\tfrac{1}{2}\text{ of the depth of cut (namely }\pm\tfrac{1}{4}\text{ on }\tfrac{1}{2}\text{ inch of cut , or 50\%).}$$

However, if one removed the same volume i.e. 72 cubic inches by using a grinder that was half the width i.e. 6 feet per unit length L of road one would cut to a depth of 1 inch with a variance of ±¼ inch. Therefore, the volume of first ground asphalt portion that would be removed would be represented by the formula V=W×D×L with a Var of ±¼=72 inches×1 inch×1 =72 $in^3$ Var ±18 $in^3$,
(i.e. ±¼ inch on 1 inch cut or 25% of 72 $in^3$).

If one was to cut a three foot wide strip with two inch cut in depth per cut:

$$V=36\times 2\times 1=72\text{ cubic inches Var }\pm 9\text{ cubic inches.}$$

Therefore, the accuracy of the new mix that is added to substitute for the first ground asphalt portion that is removed can be improved by increasing the depth of cut. Stated another way, the accuracy of the new mix to be added is directly proportional to the depth of cut for a constant volume, i.e.:

$$\text{Accuracy}\approx D$$

In other words, if we increase the depth by 2 the accuracy of controlling the removed volume is improved by a factor of 2.

In other words, the amount of new asphalt to be added can be better controlled. In the example referred to above, the volume was constant.

However, the same improved level of accuracy controlling the ratio can be realized by keeping the width W of cut constant and cutting to a greater depth.

Moreover, the invention described above has applicability to a single stage version of the process previously described, namely:

1. a method of rejuvenating an asphalt-paved road surface comprising
   (a) grinding a first portion of the road surface to a selected depth and width to produce a first loosened asphalt portion;
   (b) removing the first loosened asphalt portion to present a strip in the central region of the remaining portion of the road surface;
   (c) heating the remaining portion of the road surface;
   (d) grinding said heated remaining portion of the road surface to a selected depth to present a second loosened asphalt portion, and
   (e) introducing fresh asphalt to loosen the asphalt portion so as to repair said road.

The accuracy of the method described above as well as the method previously described can be improved by increasing the depth of cut. The examples referred to above dealt with the issue of a constant volume. However, improved control of the ratio can also be realized by keeping the width W constant and increasing the depth of cut within the physical limitations of the grinding or loosening machine.

Various embodiments of the invention have been described herein. Since changes in and/or additions to the above described invention may be made without departing from the nature, spirit or scope of the invention, and the invention should not be limited the details which have been given as an example only.

The invention claimed is:

1. A method of rejuvenating an asphalt-paved road surface comprising:

(a) grinding a portion of said road surface to produce a first loosened asphalt portion;

(b) removing the first loosened asphalt portion to present a recess means in the remaining portion of the road;

(c) heating the remaining portion of said road;

(d) grinding the heated remaining portion of the road to present a second loosened asphalt portion;

(e) gathering said second loosened asphalt portion on to the recess means and exposing a lower layer of remaining portion of the road;

(f) heating the lower layer of the remaining portion of the road;

(g) gathering the heated lower layer of the remaining portion of the road to present a third loosened asphalt portion;

(h) commingling the third loosened asphalt portion with the second loosened asphalt portion on to said recess means;

(i) introducing fresh asphalt to said commingled asphalt portion so as to repair said road.

2. A method as claim in claim 1 wherein said recess means comprises a recess.

3. A method as claimed in claim 2 wherein said recess comprises a strip disposed along a longitudinal section of said road surface.

4. A method as claimed in claim 3 wherein said remaining portion of said road comprises a transverse section of said road.

5. A method as claimed in claim 4 wherein said lower layer of the remaining portion of said road comprises a transverse section of said road.

6. A method as claimed in claim 3 wherein said gathering steps comprises windrowing said asphalt portions onto said strip.

7. A method as claimed in claim 6 wherein said strip is disposed in the central region of said road surface.

8. A method as claimed in claim 6 wherein said strip is disposed to either side of said road surface.

9. A method of rejuvenating an asphalt-paved road surface comprising:

grinding a first portion of said road surface to a selected depth and width to produce a first loosened asphalt portion (a) removing said first loosened asphalt portion to present a strip in the central region of the remaining portion of said road surface;

(b) heating the remaining portion of the road surface to a selected temperature and time duration;

(c) grinding said heated remaining portion of said road surface to a selected depth to present a second loosened asphalt portion;

(d) windrowing the second loosened asphalt portion onto said strip to expose a lower layer of the remaining portion of said road;

(e) heating the lower layer of the remaining portion of said road to a selected temperature and time duration;

(f) grinding the heated lower layer of the remaining portion of said road to a selected depth to present a third loosened asphalt portion;

(g) windrowing the third ground asphalt portion on to said strip and commingling said third ground asphalt portion with said second ground portion;

(h) introducing fresh asphalt to said commingled asphalt portion so as to repair said road.

10. A method as claimed in claim 9 wherein the depth and width of grinding a first portion of the road surface is selected to produce an improved accuracy in the control of the volume of loosened asphalt portion that is removed.

11. A method as claim 10 wherein the selected depth of loosened asphalt portion is increased and at the same time the selected width is decreased in order to increase the accuracy of volume of loosened asphalt portion to be removed.

* * * * *